US011594086B2

(12) United States Patent
Ehrlich

(10) Patent No.: US 11,594,086 B2
(45) Date of Patent: Feb. 28, 2023

(54) AUTOMATIC SWITCHING FOR FRICTIONLESS ACCESS CONTROL

(71) Applicant: Johnson Controls Tyco IP Holdings LLP, Milwaukee, WI (US)

(72) Inventor: Alexis B. Ehrlich, Boca Raton, FL (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 68 days.

(21) Appl. No.: 17/216,312

(22) Filed: Mar. 29, 2021

(65) Prior Publication Data

US 2022/0309851 A1 Sep. 29, 2022

(51) Int. Cl.
*G07C 9/00* (2020.01)

(52) U.S. Cl.
CPC ..... *G07C 9/00563* (2013.01); *G07C 9/00309* (2013.01); *G07C 9/00571* (2013.01)

(58) Field of Classification Search
None
See application file for complete search history.

*Primary Examiner* — K. Wong
(74) *Attorney, Agent, or Firm* — ArentFox Schiff LLP

(57) ABSTRACT

Example aspects include a method, an apparatus and a computer-readable medium of operating an access control system, comprising detecting a person at an access control area. The aspects further include determining whether the person is wearing a mask. Additionally, the aspects further include switching, in response to determining that the person is wearing the mask, the access control system into a frictionless mode. Additionally, the aspects further include obtaining, according to the frictionless mode, identification information of the person via touchless interaction between the person and the access control system. Additionally, the aspects further include identifying the person according to the identification information of the person.

20 Claims, 4 Drawing Sheets

AUTOMATIC SWITCHING FOR FRICTIONLESS ACCESS CONTROL

BACKGROUND

Technical Field

The present disclosure relates generally to access control systems, and more particularly, to systems and methods for automatically switching an access control system into a frictionless mode.

Introduction

Access control systems may be used to selectively provide people with access to specific locations in a building and/or facility. The access control systems may provide access by permitting a person to pass through a checkpoint, such as a door, a gate, a turnstile, an elevator, an identification checkpoint, and/or other impediments. For example, the access control systems may require the person to present identification information in order to obtain permission to pass through the checkpoint to enter and/or exit one or more areas. The access control systems may comprise keypads, card readers, key fob readers, cameras, biometric sensors, beacons, and/or other devices to receive the identification information, and may determine whether or not to permit the person to access the one or more areas based on the received identification information. Typically, the person may need to touch a device of the access control system in order to present the identification information, such as scanning an identification card, entering a code on a keypad, and touching a fingerprint sensor. These physical procedures for presenting the identification information may not be desirable during an epidemic or pandemic, as these physical procedures may facilitate the spread of a contagious disease (e.g., COVID-19). Entities that own, manage, or use such access control systems may implement manual processes to reduce the risk of contagion presented by these physical procedures. For example, the entities may implement sanitizing protocols (e.g., wiping with a disinfectant cloth, spraying device with a disinfectant spray) to be followed after each use of the access control devices. However, these sanitizing protocols may be time consuming, cause significant delays in accessing an area, and/or be ineffective.

As a result, the conventional access control systems may facilitate the spread of a contagious disease. Thus, there exists a need for further improvements to access control systems.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In contrast to the conventional solutions described, the present disclosure includes alternate identification systems and procedures that do not require a person to touch the access control devices (e.g., frictionless procedures) for presenting the identification information. The frictionless procedures may include, but are not be limited to, voice recognition, gesture scans, card or tag touchless scans, iris scans, heartbeat scans, gait analysis, and/or presenting the identification information via a user device of the person. In an aspect, the systems described herein may be configured to automatically switch into a frictionless mode that obtains identification using at least one frictionless procedure.

An example aspect includes a method of operating an access control system, comprising detecting a person at an access control area. The method further includes determining whether the person is wearing a mask. Additionally, the method further includes switching, in response to determining that the person is wearing the mask, the access control system into a frictionless mode. Additionally, the method further includes obtaining, according to the frictionless mode, identification information of the person via touchless interaction between the person and the access control system. Additionally, the method further includes identifying the person according to the identification information of the person, Another example aspect includes an apparatus of an access control system, comprising a non-transitory memory storing computer-executable instructions and a processor communicatively coupled with the non-transitory memory. The processor is configured to execute the computer-executable instructions to detect a person at an access control area. The processor is further configured to determine whether the person is wearing a mask. Additionally, the processor is further configured to execute further instructions to switch, in response to a determination that the person is wearing the mask, the access control system into a frictionless mode. Additionally, the processor is further configured to execute further instructions to obtain, according to the frictionless mode, identification information of the person via touchless interaction between the person and the access control system. Additionally, the processor is further configured to execute further instructions to identify the person according to the identification information of the person.

Another example aspect includes a non-transitory computer-readable medium storing computer-readable instructions for operating an access control system, executable by a processor to detect a person at an access control area. The instructions are further executable to determine whether the person is wearing a mask. Additionally, the instructions are further executable to switch, in response to a determination that the person is wearing the mask, the access control system into a frictionless mode. Additionally, the instructions are further executable to obtain, according to the frictionless mode, identification information of the person via touchless interaction between the person and the access control system. Additionally, the instructions are further executable to identify the person according to the identification information of the person.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

Figure 1:
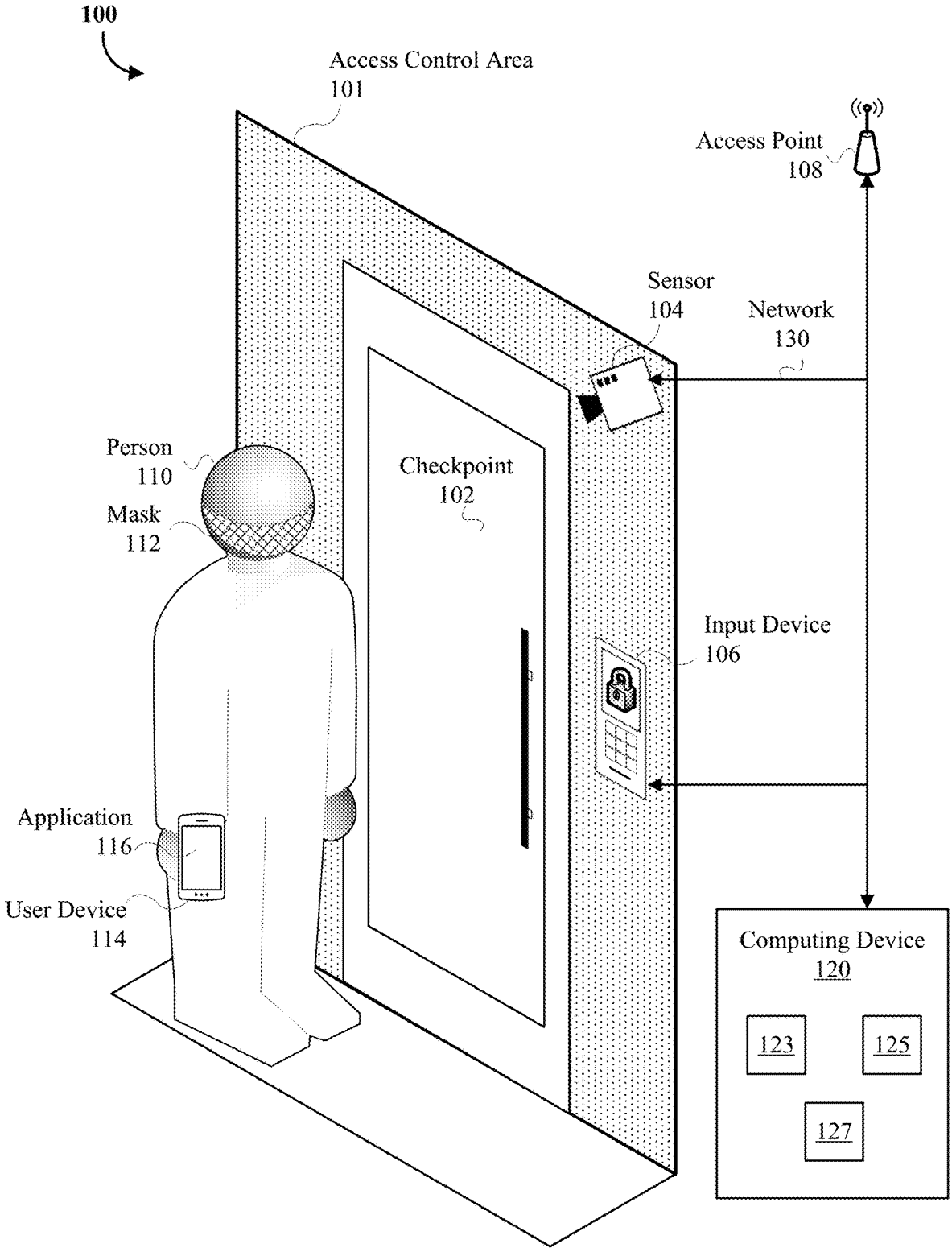
FIG. 1 is a schematic diagram illustrating an example of an access control system, in accordance with various aspects of the present disclosure.

It will be readily understood that the components of the aspects as generally described herein and illustrated in the appended figures could be arranged and designed in a wide variety of different configurations. Thus, the following more detailed description of various aspects, as represented in the figures, is not intended to limit the scope of the present disclosure, but is merely representative of various aspects. While the various aspects of the aspects are presented in drawings, the drawings are not necessarily drawn to scale unless specifically indicated.

The present solution may be embodied in other specific forms without departing from its spirit or essential characteristics. The described aspects are to be considered in all respects only as illustrative and not restrictive. The scope of the present solution is indicated by the appended claims rather than by this detailed description. All changes that come within the meaning and range of equivalency of the claims are to be embraced within their scope.

Reference throughout this specification to features, advantages, or similar language does not imply that all of the features and advantages that may be realized with the present solution should be or are in any single aspect of the present solution. Rather, language referring to the features and advantages is understood to mean that a specific feature, advantage, or characteristic described in connection with an aspect is included in at least one aspect of the present solution. Thus, discussions of the features and advantages, and similar language, throughout the specification may, but do not necessarily, refer to the same aspect.

Furthermore, the described features, advantages, and characteristics of the present solution may be combined in any suitable manner in one or more aspects. One skilled in the relevant art will recognize, in light of the description herein, that the present solution can be practiced without one or more of the specific features or advantages of a particular aspect. In other instances, additional features and advantages may be recognized in certain aspects that may not be present in all aspects of the present solution.

Reference throughout this specification to "one aspect," "an aspect," or similar language means that a particular feature, structure, or characteristic described in connection with the indicated aspect is included in at least one aspect of the present solution. Thus, the phrases "in one aspect", "in an aspect," and similar language throughout this specification may, but do not necessarily, all refer to the same aspect.

As used in this document, the singular form "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

Conventional access control systems may facilitate the spread of a contagious disease by requiring identification information that needs to be provided by a person touching a portion of the access control system. That is, an infected person may touch the portion of the access control system to provide the identification information, and subsequent persons that use the access control system may become infected as they touch the same portion of the access control system. For example, an infected person may enter a code on a keypad of the access control system, scan a keycard in a keycard scanner of the access control system, and/or provide a fingerprint scan by touching a fingerprint scanner of the access control system, and subsequent persons may be infected as they provide their identification information to the access control system in a similar manner.

The present disclosure provides systems configured to automatically switch from a touch-based mode into a frictionless mode that requires identification using at least one frictionless procedure, which do not require the person to touch the access control devices (e.g., frictionless procedures) for presenting the identification information. The present disclosure provides advantages over conventional access control systems, where an entity that owns, manages, or uses these conventional access control systems may have to resort to manual processes to reduce the risk of contagion. For example, the entities that operate conventional access control system may have to implement sanitation protocols (e.g., wiping device with a disinfectant cloth, spraying device with a disinfectant spray) that are to be followed after each use of the access control system.

These sanitizing protocols may be excessively time and labor intensive to implement, as well as, subject to ineffectiveness due to human error. For example, a building and/or facility may have thousands of employees working at the facility with a great majority of the employees attempting to enter and/or exit the facility during narrow time windows (e.g., 9:00 am, 5:00 pm). Furthermore, the access control systems may comprise a large quantity of access checkpoints. Thus, the sanitizing protocols may introduce significant delays in accessing the facility as the access checkpoints are temporarily inaccessible after each use while the sanitizing protocols are performed, in addition to being impractical to implement. Furthermore, personnel (e.g., security personnel) tasked with implementing the sanitation protocols may unintentionally leave behind infectious material, and/or be engaged in other duties (e.g., assisting visitors) and fail to sanitize the access control devices after one or more uses.

Examples of the technology disclosed herein provide for multiple manners to operate an access control system to automatically switch from a touch-based mode into a frictionless mode that provides for frictionless identification of a person. In certain aspects, the automatic switching into the frictionless mode may reduce time and labor needed for prevent the spread of a contagious disease. Further, aspects presented herein may increase effectiveness of sanitation protocols over conventional access control systems.

These and other features of the present disclosure are discussed in detail below with regard to FIGS. 1-4.

FIG. 1 is a diagram illustrating an example of an access control system 100. The access control system 100 may be configured automatically switch into a frictionless mode to provide a person 110 with frictionless access to specific locations in a building and/or facility, such as access control area 101. That is, the access control system 100 may be configured to obtain identification information of the person 110 via frictionless and/or touchless interactions between the person 110 and the access control system 100. For example, the person 110 may provide identification information to the access control system 100 without physical contact with the access control system 100. Alternatively or additionally, in some cases, the access control system 100 may be configured to obtain other identification information of the person 110 via other physical interactions between the person 110 and the access control system 100. That is, the access control system 100 may obtain the other identification information via other physical interactions that require the person 110 to touch a device of the access control system 100.

In some aspects, the access control system 100 may be configured to automatically switch into a frictionless mode in response to determining that the person 110 is wearing a mask 112. That is, the mask wearing by the person 110 may be indicative that the person 110 wishes to avoid possible contagion from touching a portion of the access control system 100, and/or indicative that protocols for preventing the spread of a contagious disease may be in place. As such, the access control system 100 may be configured to automatically switch into the frictionless mode to reduce the risk of contagion by the access control system 100.

For example, the access control system 100 may determine that the person 110 is wearing the mask 112 if or when the nose and/or mouth of the person 110 are covered. The frictionless mode may configure the access control system 100 to obtain the identification information of the person 110 only via frictionless and/or touchless interactions between the person 110 and the access control system 100. That is, the frictionless mode may enable frictionless procedures to obtain the identification information, and may disable physical procedures to obtain identification information that requires physical interactions (e.g., touching). In other optional or additional aspects, the access control system 100 may be configured to automatically switch to the frictionless mode based on determining that a time period requirement has been met. For example, the access control system 100 may automatically switch to the frictionless mode if or when the access control system 100 has determined that the time period requirement has been met.

The access control area 101 may comprise a checkpoint 102. The checkpoint 102 may be a door, a gate, a turnstile, an elevator, an identification checkpoint, and/or an entryway that may prevent access to an area. In some aspects, the checkpoint 102 may comprise a locking mechanism. For example, the checkpoint 102 may be a locking door to a private office. The locking mechanism of the checkpoint 102 may be actuated and/or toggled (e.g., locked, unlocked) by the access control system 100. That is, the access control system 100 may unlock the checkpoint 102 if or when the access control system 100 determines that the person 110 located at the access control area 101 is permitted to pass through the checkpoint 102. Alternatively or additionally, the access control system 100 may lock the checkpoint 102 if or when the access control system 100 determines that the person 110 located at the access control area 101 is not permitted to pass through the checkpoint 102.

The access control system 100 may employ a sensor 104 that may be arranged to capture data (e.g., visual data, infrared data, motion data) from the access control area 101. In some aspects, the access control system 100 may detect whether a person 110 is located at the access control area 101 based at least on data captured by the sensor 104. Alternatively or additionally, the access control system 100 may employ a different quantity of sensors 104 as that shown in FIG. 1, without departing from the scope described herein.

In some aspects, the sensor 104 may comprise a camera, such as a digital video camera or a security camera. The camera may capture visual data of the access control area 101 and provide the visual data to the access control system 100. The visual data may comprise images, video frames, and/or video feeds of the access control area 101. Image quality of the visual data (e.g., resolution, frame rate) may be sufficient to determine whether the person 110 is located at the access control area 101 and/or whether the person 110 located at the access control area 101 is wearing a mask 112. The camera may be generally oriented in a default direction to capture the access control area 101 where activity may be expected. Alternatively or additionally, the camera may be mounted on a gimbal that may allow for rotation and/or panning of the camera. For example, the access control system 100 may move the camera to maintain a field of view of the camera on the person 110. In some aspects, the access control system 100 may allow for manual control of the rotation and/or panning of the camera (e.g., by security personnel).

In other optional or additional aspects, the sensor 104 may comprise an infrared and/or thermal sensor. The infrared and/or thermal sensor may capture infrared and/or thermal data of the access control area 101 and provide the infrared and/or thermal data to the access control system 100. The infrared and/or thermal data may comprise heat maps, images, video frames, and/or video feeds of the access control area 101. In some aspects, the access control system 100 may determine whether the person 110 is located at the access control area 101 based on the infrared and/or thermal data.

In other optional or additional aspects, the sensor 104 may comprise a proximity and/or motion sensor. The proximity and/or motion sensor may capture motion data of the access control area 101 and provide the motion data to the access control system 100. In some aspects, the access control system 100 may determine whether the person 110 is located at the access control area 101 based on the motion data.

The access control area 101 may comprise an input device 106 configured to receive identification information (e.g., identification card scan, biometric data) from the person 110. Alternatively or additionally, the input device 106 may provide feedback of the progress and/or status (e.g., access granted, access denied) of the identification process to the person 110. In some aspects, the input device 106 may comprise at least one of a magnetic stripe reader, a card scanner, a near field communication ("NFC") reader, and a radio frequency identification ("RFID") reader. In such aspects, the access control system 100 may obtain the identification information of the person 110 via the input device 106 by scanning an identification device presented by the person 110 (e.g., magnetic card, badge, key fob, NFC card, RFID tag, or the like.)

In other optional or additional aspects, the input device 106 may comprise a keypad, keyboard, and/or touch-sensitive display configured to receive touch input. In such aspects, the input device 106 may prompt the person 110 to enter the identification information of the person 110 via touch input. The identification information of the person 110 may comprise an alphanumeric passcode and/or pattern that the person 110 may enter into the input device 106 to perform the identification. For example, the input device 106 may prompt the person 110 to enter a personal identification number ("PIN") into the input device 106. In another example, the input device 106 may prompt the person 110 to enter a passcode that is shared by a group of people. That is, the shared passcode may identify the person 110 as belonging to a particular group of people (e.g., engineering department, third floor residents) associated with the shared passcode. In yet another example, the input device 106 may prompt the person 110 to enter a gesture and/or pattern into the input device 106. That is, the person 110 may be prompted to trace a shape or pattern on the touch-sensitive display of the input device 106 using one or more fingers.

In other optional or additional aspects, the input device 106 may comprise a microphone. In such aspects, the input device 106 may receive identification information comprising voice and/or audio data from the person 110. For example, the voice and/or audio data from the person 110 may be analyzed to perform voice recognition to identify the person 110. That is, the access control system 100 may perform voice recognition analysis on a set of words or phrases spoken by the person 110 to identify the voice of the speaker as corresponding to the person 110. Alternatively or additionally, the access control system 100 may perform speech recognition analysis on a predetermined set of words or phrases (e.g., verbal passcode) spoken by the person 110 to recognize the predetermined set of words or phrases. That is, the access control system 100 may identify the person 110 based on a determination that the set of words or phrases spoken by the person 110 match a predetermined verbal passcode. In some aspects, the input device 106 may receive the voice and/or audio data without physical interaction with the person 110. That is, the access control system 100 may be configured to provide such an identification procedure if or when the access control system 100 is configured in the frictionless mode.

In other optional or additional aspects, the input device 106 may comprise a camera configured to receive gesture input from the person 110. In such aspects, the input device 106 may prompt the person 110 to provide the identification information of the person 110 by performing a gesture. The camera of the input device 106 may capture body movements of the person 110 and the access control system 100 may identify the person 110 based at least on the captured body movements. For example, the access control system 100 may utilize a gesture recognition algorithm to identify the gesture performed by the person 110. Alternatively or additionally, the input device 106 may capture gesture data (e.g., body movements) from the sensor 104 (e.g., video camera, infrared camera, motion detector).

In other optional or additional aspects, the input device 106 may comprise one or more biometric sensors configured to receive biometric identification information from the person 110. The one or more biometric sensors may comprise at least one of an iris scanner, a heartbeat scanner, and a gait sensor. In such aspects, the access control system 100 may identify the person 110 based at least on one or more of the biometric sensor data. One or more of the biometric sensors may receive biometric identification information from the person 110 without physical interaction with the person 110. That is, the access control system 100 may be configured to provide such identification procedures if or when the access control system 100 is configured in the frictionless mode.

In other optional or additional aspects, the input device 106 may comprise a display configured to display textual, graphical, and/or video messages generated by the access control system 100. For example, the display may show alerts generated by the access control system 100 indicating that the person 110 has been granted access. For example, the display may show a green light and/or an image of an open lock to indicate that the person 110 has been granted access. Alternatively or additionally, the display may show alerts generated by the access control system 100 indicating that the person 110 has been denied access. For example, the display may show a red light and/or an image of a closed lock to indicate that the person 110 has been denied access. In some aspects, the display may show alerts generated by the access control system 100 indicating that the person 110 is not wearing a mask.

In other optional or additional aspects, the input device 106 may comprise a speaker configured to generate an alert that may be audible by the person 110 located at the access control area 101. For example, the speaker may generate one or more sounds (e.g., a bell sound) indicating that the person 110 has been granted access. Alternatively or additionally, the speaker may generate one or more other sounds (e.g., a buzzer sound) indicating that the person 110 has been denied access. In some aspects, the speaker may comprise, or be part of, a public announcement system.

In some aspects, the access control system 100 may comprise an access point ("AP") 108. The AP 108 may provide connectivity over at least one wireless communication protocol (e.g., RFID, NFC, Wireless Fidelity ("WiFi"), Light Fidelity ("LiFi"), Bluetooth, Bluetooth Low Energy ("BLE"), ZWave, Zigbee, and the like). In some aspects, the access control system 100 may detect that a user device 114 of the person 110 is within a threshold distance from the access control area 101. For example, the access control system 100 may detect that the user device 114 is within a coverage area of the AP 108.

The sensor 104, the input device 106, the AP 108, and a computing device 120 of the access control system 100 may be communicatively coupled with a network 130, such as the Internet. Other networks may also or alternatively be used, including but not limited to private intranets, corporate networks, local area networks ("LAN"), metropolitan area networks ("MAN"), wireless networks, personal networks ("PAN"), and the like. Alternatively or additionally, the sensor 104, the input device 106, the AP 108, and/or the computing device 120 may be communicatively coupled directly (e.g., hard-wired) with another element of the access control system 100 (e.g., the sensor 104, the input device 106, the AP 108, the computing device 120).

In some aspects, the user device 114 of the person 110 may communicate with the access control system 100. The user device 114 may include, but not be limited to, a laptop or tablet computer, a cellular telephone, a smart phone, a personal digital assistant ("PDA"), a handheld device, a wearable device (e.g., a smart watch), and/or another computer device having wired and/or wireless connection capability with one or more other devices. In other aspects, the user device 114 may execute an access control application 116 for access control. For example, the user device 114 may execute the access control application 116 to connect with the access control system 100, to register an association between the user device 114 and the person 110, and/or to transmit identification information of the person 110 to the access control system 100. In other aspects, the user device 114 may communicate with the access control system 100 (e.g., input device 106, computing device 120) over a connection established via the AP 108. For example, the user device 114 may establish a connection with the access control system 100 by executing the access control application 116. For another example, the user device 114 may transmit a signal (e.g., a Bluetooth signal) to the AP 108 upon entering the range of the AP 108. The signal may indicate to the access control system 100 that the user device 114 has entered a coverage area of the AP 108. That is, the access control system 100 may determine that the user device 114 is within a threshold distance from the access control area 101.

The user device 114 may be configured to register with the access control system 100. For example, the user device 114 may provide registration information to the access control system 100 (e.g., using the access control application 116) to register an association between the person 110 and the user device 114. Alternatively or additionally, the user device 114 may register an association between the person 110 and the access control application 116. The association may indicate a correspondence between the user device 114 and the person 110. In some aspects, the access control system 100 may accept identification information of the person 110 from the user device 114 based at least on the registered association between the person 110 and the user device 114. Alternatively or additionally, the access control system 100 may reject identification information of the person 110 from another user device 114 that is not registered to the person 110.

In some aspects, the user device 114 may be configured to transmit identification information of the person 110 and/or of the user device 114 to the access control system 100 to identify the person 110. That is, the user device 114 may transmit identification information that is individually associated with the user device 114 and/or with the access control application 116. For example, the identification information may comprise an identifier generated by the person 110 (e.g., password), an identifier generated by the access control system 100 (e.g., a single-use code, a Quick Response ("QR") code), and/or an identifier of the user device 114 (e.g., a media access control ("MAC") address). The access control system 100 may identify the person 110 based at least on such identification information.

In other optional or additional aspects, the user device 114 may comprise a camera. In such aspects, the access control system 100 may obtain visual data from the camera of the user device 114. For example, the access control system 100 may determine whether the person 110 is wearing the mask 112 based on the visual data from the camera of the user device 114. In other optional or additional aspects, the user device 114 may comprise one or more biometric sensors (e.g., fingerprint, heart rate). In such aspects, the access control system 100 may obtain biometric data from the biometric sensors of the user device 114 and identify the person 110 based at least on the biometric data.

The computing device 120 may be any type of known computer, server, or data processing device. For example, the computing device 120 may be any mobile or fixed computer device including but not limited to a computer server, a desktop or laptop or tablet computer, a cellular telephone, a PDA, a handheld device, any other computer device having wired and/or wireless connection capability with one or more other devices, or any other type of computerized device capable of processing data captured by the sensor 104 and/or input device 106. In some aspects, the computing device 120 may be a cloud-based or shared computing structure accessible through the network 130. The computing device 120 may be located in a location remote from the access control area 101, or may be integrated as part of the access control system 100.

The computing device 120 may comprise a processor 123 which may be configured to execute or implement software, hardware, and/or firmware modules that perform any functionality described herein. For example, the processor 123 may be configured to execute or implement software, hardware, and/or firmware modules that perform any functionality described herein with reference to a frictionless access control component 127 or any other component/system/device described herein.

The processor 123 may be a micro-controller, an application-specific integrated circuit ("ASIC"), a digital signal processor ("DSP"), or a field-programmable gate array ("FPGA"), and/or may comprise a single or multiple set of processors or multi-core processors. Moreover, the processor 123 may be implemented as an integrated processing system and/or a distributed processing system. The computing device 120 may further comprise a memory 125, such as for storing local versions of applications being executed by the processor 123, or related instructions, parameters, and the like.

The memory 125 may include a type of non-transitory memory usable by a computer, such as random access memory ("RAM"), read only memory ("ROM"), tapes, magnetic discs, optical discs, solid state drives ("SSDs"), volatile memory, non-volatile memory, and any combination thereof. Alternatively or additionally, the processor 123 and the memory 125 may comprise and execute an operating system executing on the processor 123, one or more applications, display drivers, etc., and/or other components of the computing device 120.

The computing device 120 may comprise a frictionless access control component 127 configured to detect a person 110 at the access control area 101, to determine whether the person 110 is wearing the mask 112, to switch the access control system 100 into a frictionless mode, to obtain identification information of the person 110 via touchless interaction between the person 110 and the access control system 100, and to identify the person 110 according to the identification information of the person 110. In some aspects, the frictionless access control component 127 may be configured to automatically switch to the frictionless mode based on determining that a time period requirement has been met.

Aspects of the present disclosure may be implemented using hardware, software, or a combination thereof and may be implemented in one or more computer systems or other processing systems. In an aspect of the present disclosure, features are directed toward one or more computer systems capable of carrying out the functionality described herein. An example of such a computer system is shown in FIG. 2.

Figure 2:
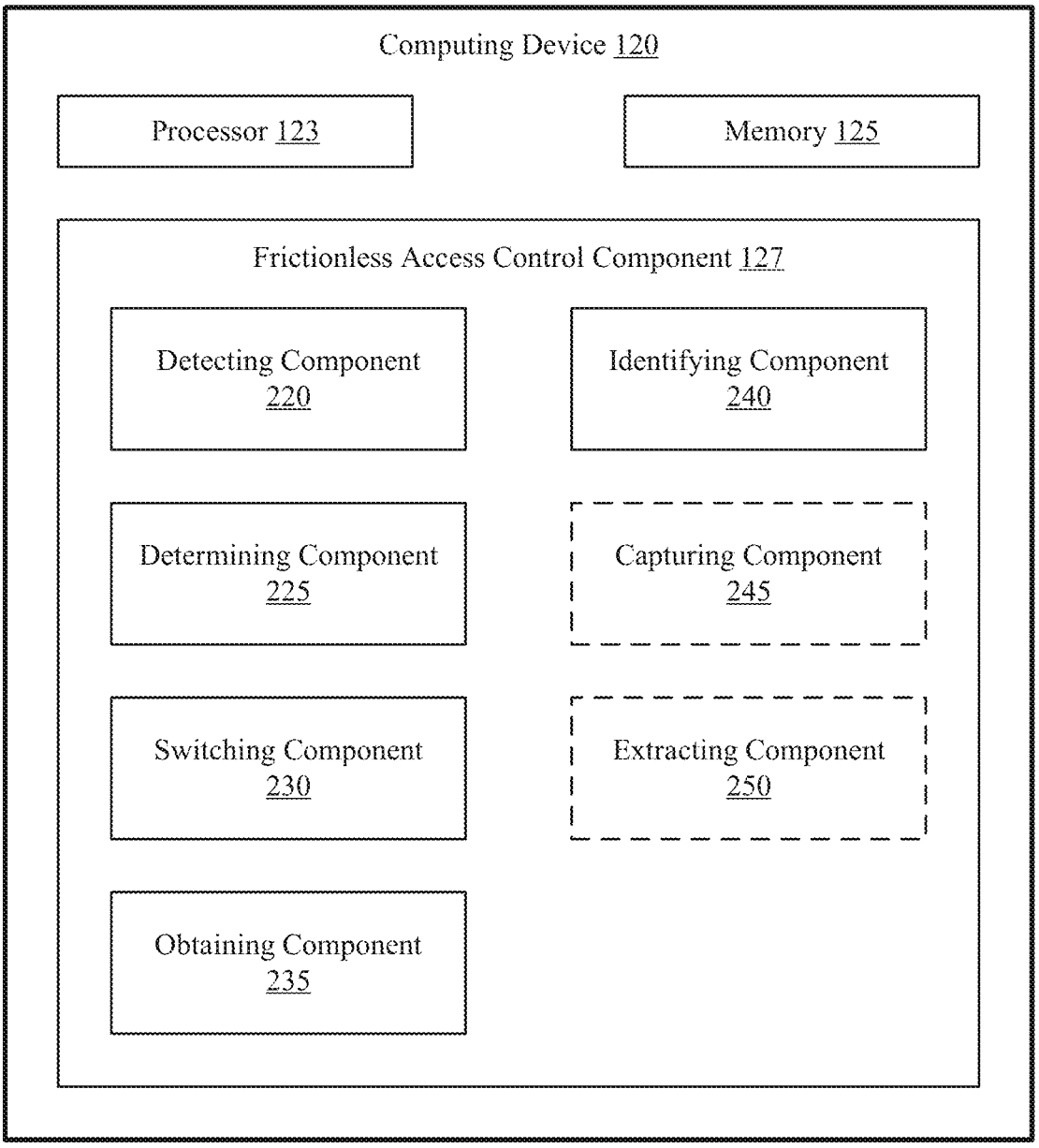
FIG. 2 is a block diagram of an example apparatus such as a computing device for operating an access control system, in accordance with various aspects of the present disclosure.

FIG. 2 is a block diagram of an example computing device 120 for operating the access control system 100. The computing device 120 depicted in FIG. 2 is similar in many respects to the computing device 120 described above with reference to FIG. 1, and may include additional features not mentioned above. In some aspects, the computing device 120 may comprise a processor 123 configured to execute or implement software, hardware, and/or firmware modules that perform any functionality described herein (e.g., frictionless access control component 127), a memory 125 configured to store computer-readable instructions for execution by the processor 123, and a frictionless access control component 127 configured to switch the access control system 100 into a frictionless mode.

In some aspects, the computing device 120 may be configured to perform one or more operations described herein in connection with FIG. 1. Alternatively or additionally, the computing device 120 may be configured to perform one or more processes described herein, such as method 300 of FIGS. 3-4. In other aspects, the computing device 120 may include one or more components of the computing device 120 described above in connection with FIG. 1.

In some aspects, the frictionless access control component 127 may include a set of components, such as a detecting component 220 configured to detect a person 110 at an access control area, a determining component 225 configured to determine whether the person 110 is wearing a mask, a switching component 230 configured to switch the access control system 100 into a frictionless mode, an obtaining component 235 configured to obtain identification information of the person, and an identifying component 240 configured to identify the person. Optionally, the frictionless access control component 127 may further include a capturing component 245 configured to capture visual data of the access control area, and an extracting component 250 configured to extract visual characteristics of the person 110 from the visual data.

Alternatively or additionally, the set of components may be separate and distinct from the frictionless access control component 127. In other aspects, one or more components of the set of components may include or may be implemented within a controller/processor (e.g., processor 123), a memory (e.g., memory 125), or a combination thereof, of the computing device 120 described in FIGS. 1-2. Alternatively or additionally, one or more components of the set of components may be implemented at least in part as software stored in a memory, such as memory 125. For example, a component (or a portion of a component) may be implemented as instructions or code stored in a non-transitory computer-readable medium and executable by a controller or a processor to perform the functions or operations of the component.

The detecting component 220 may be configured to detect a person 110 at the access control area 101. That is, the detecting component 220 may receive data (e.g., visual data, infrared data, motion data) of the access control area 101. In some aspects, the detecting component 220 may receive, from the sensor 104, visual data of the access control area 101. The visual data may comprise images, video frames, and/or video feeds of the access control area 101. The image quality of the visual data (e.g., resolution, frame rate) may be sufficient to determine whether the person 110 is located at the access control area 101 and/or whether the person 110 located at the access control area 101 is wearing a mask 112. In other optional or additional aspects, the detecting component 220 may receive, from the sensor 104, infrared and/or thermal data comprising heat maps, images, video frames, and/or video feeds of the access control area 101. In other optional or additional aspects, the detecting component 220 may receive, from the sensor 104, motion data of the access control area 101.

The detecting component 220 may classify objects that appear in the received data and may determine whether objects that appear in the received data constitute a person 110. That is, the detecting component 220 may implement one or more techniques for classifying objects that appear in the received data as a person 110. In some aspects, the detecting component 220 may access a database or other data store of images and use image processing algorithms, machine learning classifiers, and the like on the received data to establish which objects appearing in the received data may likely represent a person 110. In other optional or additional aspects, the detecting component 220 may be provided with base images of the access control area 101 in which no persons are present. Alternatively or additionally, the detecting component 220 may compare the received data with the base images having no persons present to determine whether additional objects in the received data may represent the person 110. In other optional or additional aspects, the detecting component 220 may place bounding boxes around objects identified in the received data, and may discard bounding boxes whose dimensions do not meet certain thresholds as likely non-human objects. For example, the detecting component 220 may discard bounding boxes that identify objects having dimensions smaller or larger than a conventional human size (e.g., a footprint of 2 feet by 2 feet or less, a height of over 7 feet, or a width of over 4 feet). Alternatively or additionally, bounding boxes whose positions change rapidly over subsequent video frames may be discarded. As such, non-human objects, such as handcarts or suitcases may not be identified as a person 110 by the detecting component 220.

In other optional or additional aspects, the detecting component 220 may detect that the user device 114 of the person 110 is within a threshold distance of the access control area 101. For example, the detecting component 220 may detect that the user device 114 is within a coverage area of the AP 108.

The determining component 225 may be configured to determine whether the person 110 is wearing the mask 112. That is, the determining component 225 may determine whether the person 110, that has been detected by the detecting component 220, is wearing the mask 112. In some aspects, the determining component 225 may determine whether the visual characteristics of the person 110 indicate that a portion of a face of the person 110 is covered. The portion of the face of the person 110 may comprise at least one of a nose and a mouth of the person 110.

For example, if or when the visual characteristics of the person 110 do not comprise visual characteristics of a nose and a mouth, the determining component 225 may determine that the portion of the face of the person 110 is covered and that the person 110 is wearing the mask 112. That is, if or when both the nose and the mouth of the person 110 are covered (e.g., hidden from view), the person 110 is likely to be wearing the mask 112.

For another example, if or when the visual characteristics of the person 110 comprise visual characteristics of a nose and/or a mouth, the determining component 225 may determine that the portion of the face of the person 110 is uncovered and that the person 110 is not wearing the mask 112. That is, if or when the nose and/or the mouth of the person 110 are uncovered (e.g., visible), the person 110 is unlikely to be wearing the mask 112.

In other optional or additional aspects, the determining component 225 may determine whether a time period requirement is met. The time period requirement may indicate one or more time periods during which the access control system 100 is permitted to be configured in the frictionless mode. That is, the access control system 100 may be configured to be allowed to automatically switch to the frictionless mode only during the time periods indicated by the time period requirement. For example, the access control system 100 may automatically switch to the frictionless mode if or when the access control system 100 has determined that the person 110 at the access control area 101 is wearing the mask 112 and that the time period requirement indicates that the access control system 100 is allowed to automatically switch to the frictionless mode. Alternatively or additionally, the access control system 100 may be configured to automatically switch to the frictionless mode during the time periods indicated by the time period requirement. For example, the access control system 100 may automatically switch to the frictionless mode if or when the access control system 100 has determined that the time period requirement has been met.

Each time period of the one or more time periods indicated by the time period requirement may indicate a single time period (e.g., Mar. 8, 2021 from 8:00 AM to 5:00 pm) or may indicate multiple repeating time periods (e.g., Mondays from 10:00 AM to 11:00 AM, second Tuesday of each month from 1:00 PM to 3:00 PM). The present solution is not limited in this regard. Notably, the time period requirement may indicate multiple time periods with multiple repeating frequencies using multiple formats appropriate for such indications.

The switching component 230 may be configured to switch the access control system 100 into a frictionless mode. In some aspects, the switching component 230 may switch the access control system 100 into a frictionless mode in response to a determination, by the determining component 225, that the person 110 is wearing the mask 112. Alternatively or additionally, the switching component 230 may switch the access control system 100 into a frictionless mode based on another determination, by the determining component 225, that the time period requirement has been met.

The frictionless mode may configure the access control system 100 to obtain the identification information of the person 110 only via frictionless and/or touchless interactions between the person 110 and the access control system 100. That is, the frictionless mode may enable frictionless procedures to obtain the identification information, and may disable procedures to obtain the identification information that require physical interactions (e.g., touching). The frictionless procedures of obtaining the identification information may include, but not be limited to, voice scans, gesture scans, NFC card scans, RFID tag scans, iris scans, heartbeat scans, gait analysis, and/or presenting identification information (e.g., password, QR code, MAC address, biometric data, and the like) via the user device 114 of the person 110.

The obtaining component 235 may be configured to obtain, according to the frictionless mode, identification information of the person 110 via touchless interaction between the person 110 and the access control system 100. That is, the obtaining component 235 may obtain identification information of the person 110 using a frictionless procedure that comprises frictionless and/or touchless interactions between the person 110 and the access control system 100. The obtaining component 235 may be configured to provide the identification information of the person 110 to the identifying component 240 for further processing.

In some aspects, the obtaining component 235 may obtain voice and/or audio data of the person 110. The voice and/or audio data may comprise a set of words and/or phrases spoken by the person 110 for identification purposes. For example, the obtaining component 235 may obtain the voice and/or audio data from a microphone of the input device 106. Alternatively or additionally, the obtaining component 235 may obtain other voice and/or audio data from a microphone of the user device 114.

In other optional or additional aspects, the obtaining component 235 may obtain gesture data of the person 110. The gesture data may comprise body movements of the person 110 while performing a gesture. For example, the obtaining component 235 may obtain the gesture data from the camera of the input device 106 and/or from the camera of the sensor 104. Alternatively or additionally, the obtaining component 235 may obtain other gesture data from the camera of the user device 114.

In other optional or additional aspects, the obtaining component 235 may obtain identification information of the person 110 from a card scanner, a NFC reader, and/or a RFID reader of the input device 106. In such aspects, the input device 106 may perform a scan of an identification device presented by the person 110 (e.g., badge, key fob, NFC card, RFID tag, or the like) to read the identification information. Alternatively or additionally, the identification device may be comprised by the user device 114. For example, the person 110 may present the user device 114 to the input device 106 and the input device 106 may scan an identification device comprised by the user device 114.

In other optional or additional aspects, the obtaining component 235 may obtain iris scan data of the person 110. The iris scan data may comprise biometric data corresponding to one or both irises of the person 110. For example, the obtaining component 235 may obtain the iris scan data from an iris scanner of the input device 106 and/or from the camera of the sensor 104. Alternatively or additionally, the obtaining component 235 may obtain other iris scan data from the camera of the user device 114.

In other optional or additional aspects, the obtaining component 235 may obtain heartbeat scan data of the person 110. The heartbeat scan data may comprise biometric data corresponding to a geometry (e.g., size, shape) of a heart of the person 110 and/or to a beating pattern of the heart. For example, the obtaining component 235 may obtain the heartbeat scan data from a heartbeat scanner of the input device 106. Alternatively or additionally, the obtaining component 235 may obtain other heartbeat scan data from a heartbeat scanner of the user device 114.

In other optional or additional aspects, the obtaining component 235 may obtain gait scan data of the person 110. The gait scan data may comprise biometric data corresponding to a walking style and/or pace of the person 110. For example, the obtaining component 235 may obtain the gait scan data from a gait sensor of the input device 106 and/or from the camera of the sensor 104. Alternatively or additionally, the obtaining component 235 may obtain other gait scan data from the camera of the user device 114.

In other optional or additional aspects, the obtaining component 235 may obtain registration information of the user device 114 of the person 110. That is, the obtaining component 235 may register an association between the person 110 and the user device 114 of the person 110. Alternatively or additionally, the obtaining component 235 may register an association between the person 110 and the access control application 116 executed by the user device 114. The association may indicate a correspondence between the user device 114 and the person 110. The obtaining component 235 may accept identification information of the person 110 from the user device 114 based at least on the registered association between the person 110 and the user device 114. Alternatively or additionally, the obtaining component 235 may reject identification information of the person 110 from another user device 114 that is not registered to the person 110.

In other optional or additional aspects, the obtaining component 235 may obtain identification information from the user device 114 of the person 110. The identification information may be individually associated with the user device 114 and/or with the access control application 116. For example, the identification information may comprise an identifier generated by the person 110 (e.g., password), an identifier generated by the access control system 100 (e.g., a single-use code, a QR code), and/or an identifier of the user device 114 (e.g., a MAC address). In some aspects, the obtaining component 235 may obtain the identification information by receiving the identification information that has been transmitted by the user device 114. In other optional or additional aspects, the obtaining component 235 may obtain the identification information that is displayed by the user device 114 using the camera of the sensor 104 and/or the camera of the input device 106. For example, the user device 114 and/or the access control application 116 may display an image-based code (e.g., a QR code) and the obtaining component 235 may receive visual data comprising the image-based code from the camera of the sensor 104 and/or the camera of the input device 106.

The identifying component 240 may be configured to identify the person 110 according to the identification information of the person 110. That is, the identifying component 240 may identify the person 110 based at least on the identification information of the person 110 obtained by the obtaining component 235.

In some aspects, the identifying component 240 may perform voice recognition analysis on the voice and/or audio data of the person 110. That is, the identifying component 240 may perform voice recognition analysis on a set of words or phrases spoken by the person 110 to identify the voice of the speaker as corresponding to the person 110. For example, the identifying component 240 may compare the voice and/or audio data with previously recorded voice and/or audio data that is known to have been spoken by the person 110. Alternatively or additionally, the identifying component 240 may perform speech recognition analysis on a predetermined set of words or phrases (e.g., verbal passcode) spoken by the person 110 to recognize the predetermined set of words or phrases. That is, the identifying component 240 may identify the person 110 based on a determination that the set of words or phrases spoken by the person 110 match a predetermined verbal passcode corresponding to the person 110.

In other optional or additional aspects, the identifying component 240 may identify the person 110 based at least on gesture data of the person 110. In such aspects, the identifying component 240 may interpret the body movements of the person 110 while performing a gesture. The identifying component 240 may identify the person 110 based at least on a determination that the gesture performed by the person 110 matches a predetermined gesture corresponding to the person 110.

In other optional or additional aspects, the identifying component 240 may identify the person 110 based at least on identification information obtained from a scan of an identification device presented by the person 110 (e.g., badge, key fob, NFC card, RFID tag, or the like). That is, the identifying component 240 may identify the person 110 based at least on a determination that the identification information obtained from the scan corresponds to the person 110.

In other optional or additional aspects, the identifying component 240 may identify the person 110 based at least on iris scan data of the person 110. That is, the identifying component 240 may identify the person 110 based at least on a determination that the iris scan data corresponds to the person 110.

In other optional or additional aspects, the identifying component 240 may identify the person 110 based at least on heartbeat scan data of the person 110. That is, the identifying component 240 may identify the person 110 based at least on a determination that the heartbeat scan data corresponds to the person 110.

In other optional or additional aspects, the identifying component 240 may identify the person 110 based at least on gait scan data of the person 110. That is, the identifying component 240 may identify the person 110 based at least on a determination that the gait scan data corresponds to the person 110.

In other optional or additional aspects, the identifying component 240 may identify the person 110 based at least on identification information of the person 110 received from the user device 114. That is, the identifying component 240 may identify the person 110 based at least on a determination that the identification information of the person 110 received from the user device 114 corresponds to the person 110. For example, the identifying component 240 may identify the person 110 based at least on a determination that a QR code displayed by the user device 114 corresponds to the person 110.

In other optional or additional aspects, the identifying component 240 may determine whether the person 110 should be granted entry/exit based at least on a determination that the identification information identifies the person 110 and that the person 110 is permitted to be granted entry/exit. In some aspects, the identifying component 240 may cause the access control system 100 to grant access to the person 110 if or when the identifying component 240 has determined that the person 110 should be granted entry. For example, if or when the identifying component 240 has determined that the person 110 should be granted entry, the access control system 100 may unlock the locking mechanism of the checkpoint 102, may show on the display of the input device 106 a green light and/or an image of an open lock, and/or may generate, with the speaker of the input device 106, one or more sounds (e.g., a bell sound) indicating that the person 110 has been granted access.

In other optional or additional aspects, the identifying component 240 may cause the access control system 100 to deny access to the person 110 if or when the identifying component 240 has determined that the person 110 should not be granted entry/exit. For example, if or when the identifying component 240 has determined that the person 110 should be denied entry/exit, the access control system 100 may lock the locking mechanism of the checkpoint 102, may show on the display of the input device 106 a red light and/or an image of a closed lock, and/or may generate, with the speaker of the input device 106, one or more sounds (e.g., a buzzer sound) indicating that the person 110 has been denied access.

The capturing component 245 may be configured to capture visual data of the access control area 101. In some aspects, the capturing component 245 may capture the visual data from the sensor 104 and/or from the input device 106. Alternatively or additionally, the capturing component 245 may capture other visual data from the camera of user device 114. The visual data may comprise images, video frames, and/or video feeds of the access control area 101. The image quality of the visual data (e.g., resolution, frame rate) may be sufficient to determine whether the person 110 is located at the access control area 101 and/or whether the person 110 located at the access control area 101 is wearing a mask 112.

The extracting component 250 may be configured to extract visual characteristics of the person 110 from the visual data. In some aspects, the extracting component 250 may extract the visual characteristics of the person 110 using a visual characteristics detection algorithm. The visual characteristics detection algorithm may be configured to detect visual characteristics of the person 110 from the visual data. For example, the visual characteristics detection algorithm may comprise a machine learning classifier having been trained to extract visual characteristics (e.g., eyes, noses, mouths, ears) from visual data in which the person 110 appears. Alternatively or additionally, the visual characteristics detection algorithm may compare properties of base images of visual characteristics with the properties of the visual data, such as color (e.g., hue, lightness, or saturation), object shape (e.g., shape of face), object size (e.g., of person), and/or other conventional image comparison attributes.

The number and arrangement of components shown in FIG. 2 are provided as an example. In practice, there may be additional components, fewer components, different components, or differently arranged components than those shown in FIG. 2. Furthermore, two or more components shown in FIG. 2 may be implemented within a single component, or a single component shown in FIG. 2 may be implemented as multiple, distributed components. Additionally or alternatively, a set of (one or more) components shown in FIG. 2 may perform one or more functions described as being performed by another set of components shown in FIG. 1.

Figure 3:
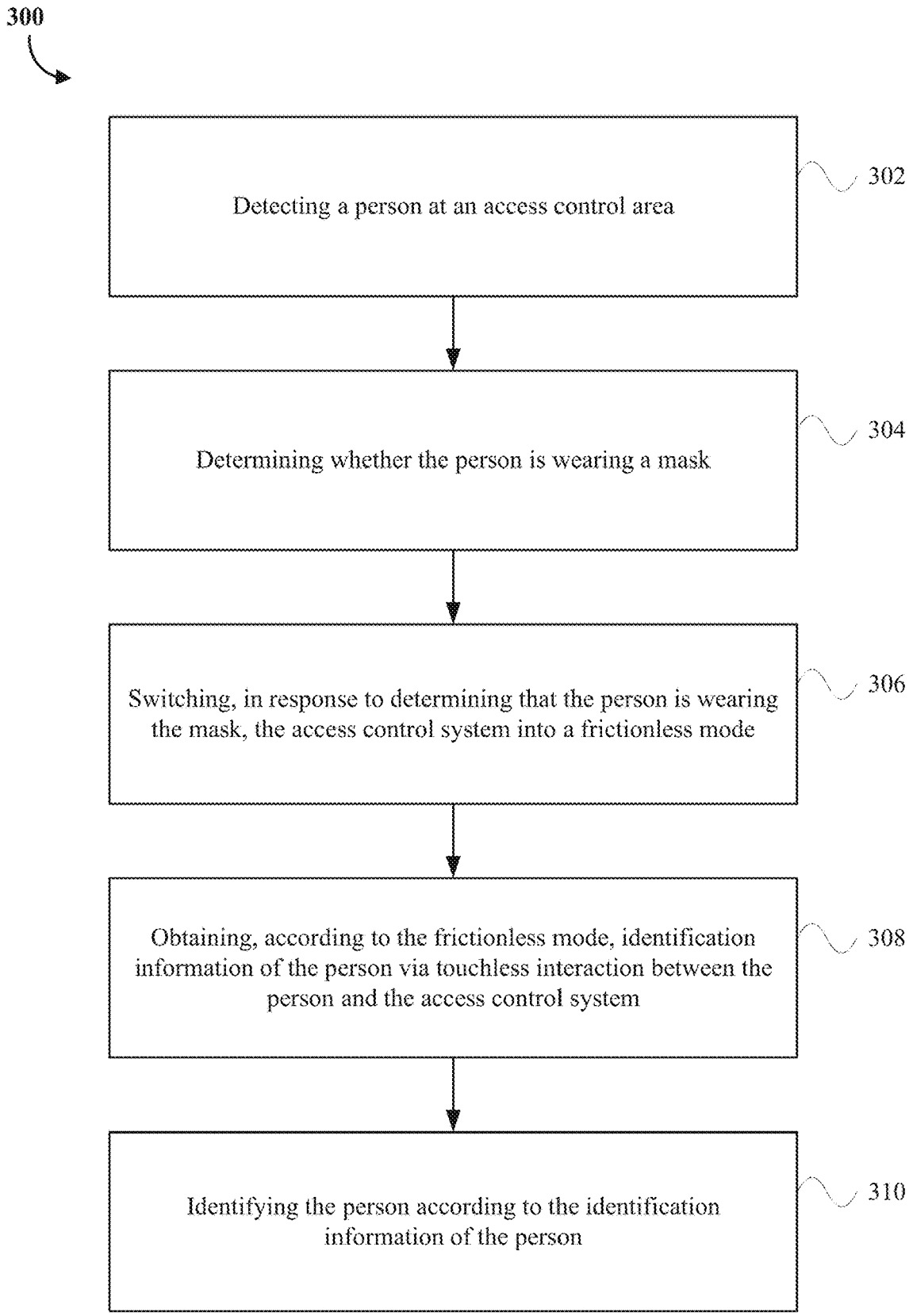
FIG. 3 is a flowchart of a method of operating an access control system to be performed by a computing device, in accordance with various aspects of the present disclosure.
Figure 4:
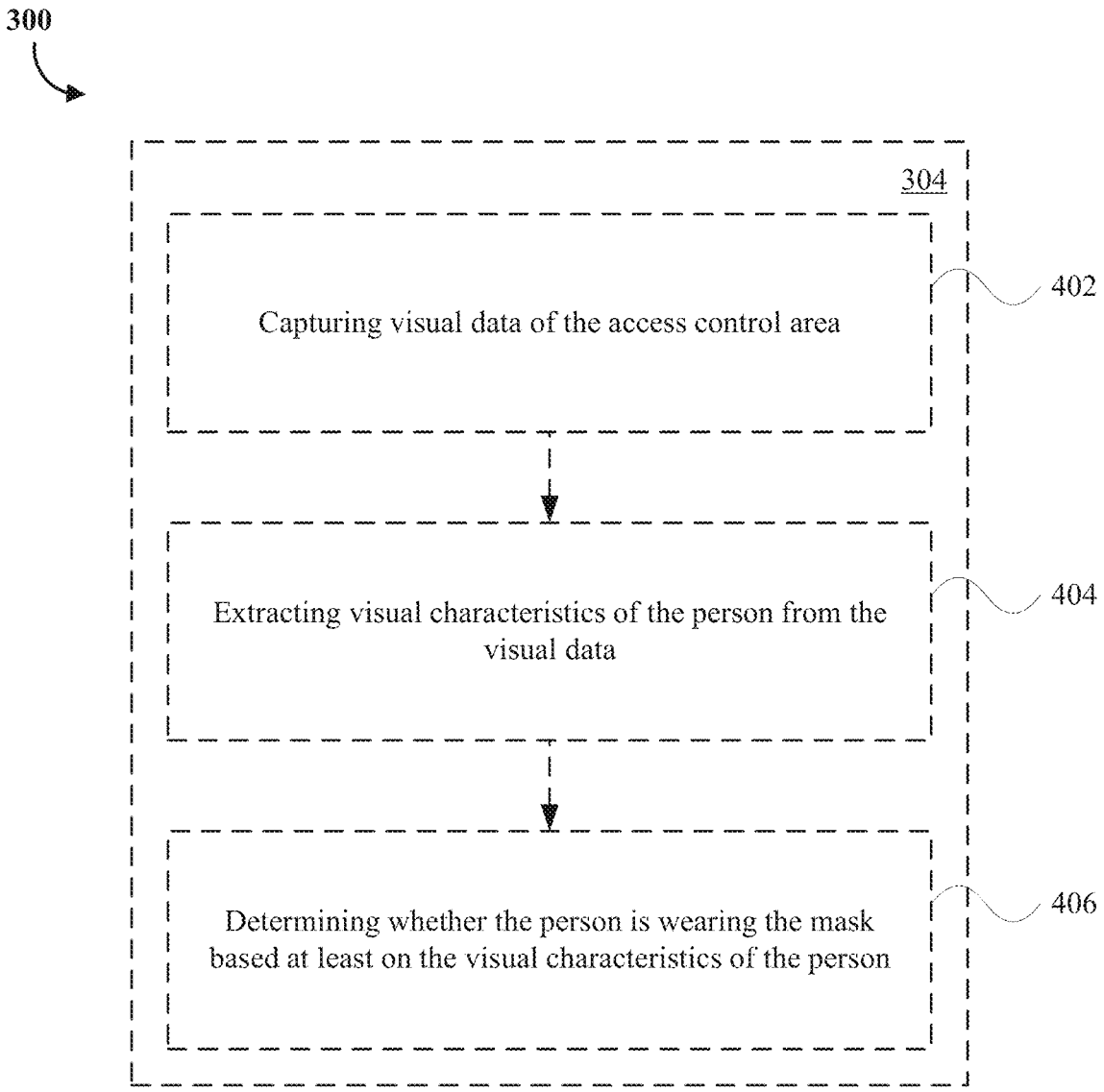
FIG. 4 is a flowchart of additional or optional steps of the method of operating an access control system to be performed by the computing device, in accordance with various aspects of the present disclosure.

Referring to FIGS. 3 and 4, in operation, the computing device 120 may perform a method 300 of operating the access control system 100. The method 300 may be performed by the computing device 120 (which may include the memory 125 and which may be the entire computing device 120 and/or one or more components of the computing device 120, such as frictionless access control component 127, processor 123, and/or memory 125.) The method 300 may be performed by the frictionless access control component 127 in communication with the sensor 104, the input device 106, and the user device 114.

At block 302, the method 300 includes detecting a person at an access control area. For example, in an aspect, the computing device 120, the processor 123, the memory 125, the frictionless access control component 127, and/or the detecting component 220 may be configured to or may comprise means for detecting the person 110 at the access control area 101.

For example, the detecting at block 302 may include receiving data (e.g., visual data, infrared data, motion data) of the access control area 101. In some aspects, the detecting at block 302 may include receiving, from the sensor 104, visual data of the access control area 101. The visual data may comprise images, video frames, and/or video feeds of the access control area 101. The image quality of the visual data (e.g., resolution, frame rate) may be sufficient to determine whether the person 110 is located at the access control area 101 and/or whether the person 110 located at the access control area 101 is wearing a mask 112. In other optional or additional aspects, the detecting at block 302 may include receiving, from the sensor 104, infrared and/or thermal data comprising heat maps, images, video frames, and/or video feeds of the access control area 101. In other optional or additional aspects, the detecting at block 302 may include receiving, from the sensor 104, motion data of the access control area 101.

In other optional or additional aspects, the detecting at block 302 may include classifying objects that appear in the received data and determining whether objects that appear in the received data constitute a person 110. That is, the detecting at block 302 may implement one or more techniques for classifying objects that appear in the received data as a person 110. In some aspects, the detecting at block 302 may include accessing a database or other data store of images and use image processing algorithms, machine learning classifiers, and the like on the received data to establish which objects appearing in the received data may likely represent a person 110. In other optional or additional aspects, the detecting at block 302 may include accessing images of the access control area 101 in which no persons are present. Alternatively or additionally, the detecting at block 302 may include comparing the received data with the base images having no persons present to determine whether additional objects in the received data may represent the person 110. In other optional or additional aspects, the detecting at block 302 may include placing bounding boxes around objects identified in the received data, and discarding bounding boxes whose dimensions do not meet certain thresholds as likely non-human objects. For example, bounding boxes that identify objects having dimensions smaller or larger than a conventional human size (e.g., a footprint of 2 feet by 2 feet or less, a height of over 7 feet, or a width of over 4 feet) may be discarded. Alternatively or additionally, bounding boxes whose positions change rapidly over subsequent video frames may be discarded. As such, non-human objects, such as handcarts or suitcases may not be identified as a person 110.

Further, for example, the detecting at block 302 may be performed to detect and classify human objects in the visual data as the person 110 and to discard non-human objects.

At block 304, the method 300 includes determining whether the person is wearing a mask. For example, in an aspect, the computing device 120, the processor 123, the memory 125, the frictionless access control component 127, and/or the determining component 225 may be configured to or may comprise means for determining whether the person 110 is wearing a mask 112.

For example, the determining at block 304 may include determining whether the person 110 is wearing the mask 112. In some aspects, the determining at block 304 may include determining whether the visual characteristics of the person 110 indicate that a portion of a face of the person 110 is covered. The portion of the face of the person 110 may comprise at least one of a nose and a mouth of the person 110.

For example, if or when the visual characteristics of the person 110 do not comprise visual characteristics of a nose and a mouth, the determining at block 304 may include determining that the portion of the face of the person 110 is covered and that the person 110 is wearing the mask 112. That is, if or when both the nose and the mouth of the person 110 are covered (e.g., hidden from view), the person 110 is likely to be wearing the mask 112.

For another example, if or when the visual characteristics of the person 110 comprise visual characteristics of a nose and/or a mouth, the determining at block 304 may include determining that the portion of the face of the person 110 is uncovered and that the person 110 is not wearing the mask 112. That is, if or when the nose and/or the mouth of the person 110 are uncovered (e.g., visible), the person 110 is unlikely to be wearing the mask 112.

In other optional or additional aspects, the determining at block 304 may include determining whether a time period requirement is met. The time period requirement may indicate one or more time periods during which the switching component 230 is permitted to be configured in the frictionless mode. That is, the switching component 230 may be configured to be allowed to automatically switch to the frictionless mode only during the time periods indicated by the time period requirement. For example, the switching component 230 may automatically switch to the frictionless mode if or when the determining component 225 has determined that the person 110 at the access control area 101 is wearing the mask 112 and the time period requirement indicates that the switching component 230 is allowed to automatically switch to the frictionless mode. Alternatively or additionally, the switching component 230 may be configured to automatically switch to the frictionless mode during the time periods indicated by the time period requirement. For example, the switching component 230 may automatically switch to the frictionless mode if or when the determining component 225 has determined that the time period requirement has been met.

Each time period of the one or more time periods indicated by the time period requirement may indicate a single time period (e.g., Mar. 8, 2021 from 8:00 AM to 5:00 pm) or may indicate multiple repeating time periods (e.g., Mondays from 10:00 AM to 11:00 AM, second Tuesday of each month from 1:00 PM to 3:00 PM).

Further, for example, the determining at block 304 may be performed to determine whether or not the access control system 100 is to be switched into the frictionless mode. Such a determination may allow the access control system 100 to be automatically switched into the frictionless mode. Thus, aspects presented herein may reduce time and labor needed for prevent the spread of a contagious disease. Further, aspects presented herein may increase effectiveness of sanitation protocols over conventional access control systems.

At block 306, the method 300 includes switching, in response to determining that the person is wearing the mask, the access control system into a frictionless mode. For example, in an aspect, the computing device 120, the processor 123, the memory 125, the frictionless access control component 127, and/or the switching component 230 may be configured to or may comprise means for switching, in response to determining that the person 110 is wearing the mask 112, the access control system 100 into a frictionless mode.

For example, the switching at block 306 may include switching the access control system 100 into a frictionless mode in response to a determination, at the block 304, that the person 110 is wearing the mask 112. The frictionless mode may configure the access control system 100 to obtain the identification information of the person 110 only via frictionless and/or touchless interactions between the person 110 and the access control system 100. That is, the frictionless mode may enable frictionless procedures to obtain the identification information, and may disable procedures to obtain the identification information that require physical interactions (e.g., touching). The frictionless procedures of obtaining the identification information may include, but not be limited to, voice scans, gesture scans, NFC card scans, RFID tag scans, iris scans, heartbeat scans, gait analysis, and/or presenting identification information (e.g., password, QR code, MAC address, biometric data, and the like) via the user device 114 of the person 110.

In other optional or additional aspects, the switching at block 306 may include switching the access control system 100 into a frictionless mode based on another determination, at the block 304, that the time period requirement has been met. The time period requirement may indicate one or more time periods during which the access control system 100 is permitted to be configured in the frictionless mode.

Further, for example, the switching at block 306 may be performed to automatically switch into the frictionless mode which provides for the frictionless identification of the person 110. Thus, aspects presented herein may reduce time and labor needed for prevent the spread of a contagious disease. Further, aspects presented herein may increase effectiveness of sanitation protocols over conventional access control systems.

At block 308, the method 300 includes obtaining, according to the frictionless mode, identification information of the person via touchless interaction between the person and the access control system. For example, in an aspect, the computing device 120, the processor 123, the memory 125, the frictionless access control component 127, and/or the obtaining component 235 may be configured to or may comprise means for obtaining, according to the frictionless mode, identification information of the person 110 via touchless interaction between the person 110 and the access control system 100.

For example, the obtaining at block 308 may include obtaining identification information of the person 110 using a frictionless procedure that comprises frictionless and/or touchless interactions between the person 110 and the access control system 100. In some aspects, the obtaining at block 308 may include obtaining voice and/or audio data of the person 110. The voice and/or audio data may comprise a set of words and/or phrases spoken by the person 110 for identification purposes. For example, the obtaining at block 308 may include obtaining the voice and/or audio data from a microphone of the input device 106. Alternatively or additionally, the obtaining at block 308 may include obtaining other voice and/or audio data from a microphone of the user device 114.

In other optional or additional aspects, the obtaining at block 308 may include obtaining gesture data of the person 110. The gesture data may comprise body movements of the person 110 while performing a gesture. For example, the obtaining at block 308 may include obtaining the gesture data from the camera of the input device 106 and/or from the camera of the sensor 104. Alternatively or additionally, the obtaining at block 308 may include obtaining other gesture data from the camera of the user device 114.

In other optional or additional aspects, the obtaining at block 308 may include obtaining identification information of the person 110 from a card scanner, a NFC reader, and/or a RFID reader of the input device 106. In such aspects, the obtaining at block 308 may include performing a scan of an identification device presented by the person 110 (e.g., badge, key fob, NFC card, RFID tag, or the like) to read the identification information. Alternatively or additionally, the obtaining at block 308 may include obtaining identification information from an identification device comprised by the user device 114 that is registered to the person 110.

In other optional or additional aspects, the obtaining at block 308 may include obtaining iris scan data of the person 110. The iris scan data may comprise biometric data corresponding to one or both irises of the person 110. For example, the obtaining at block 308 may include obtaining the iris scan data from an iris scanner of the input device 106 and/or from the camera of the sensor 104. Alternatively or additionally, the obtaining at block 308 may include obtaining other iris scan data from the camera of the user device 114.

In other optional or additional aspects, the obtaining at block 308 may include obtaining heartbeat scan data of the person 110. The heartbeat scan data may comprise biometric data corresponding to a geometry (e.g., size, shape) of a heart of the person 110 and/or to a beating pattern of the heart. For example, the obtaining component 235 may obtain the heartbeat scan data from a heartbeat scanner of the input device 106. Alternatively or additionally, the obtaining at block 308 may include obtaining other heartbeat scan data from a heartbeat scanner of the user device 114.

In other optional or additional aspects, the obtaining at block 308 may include obtaining gait scan data of the person 110. The gait scan data may comprise biometric data corresponding to a walking style and/or pace of the person 110. For example, the obtaining at block 308 may include obtaining the gait scan data from a gait sensor of the input device 106 and/or from the camera of the sensor 104. Alternatively or additionally, the obtaining at block 308 may include obtaining other gait scan data from the camera of the user device 114.

In other optional or additional aspects, the obtaining at block 308 may include obtaining registration information of the user device 114 of the person 110. That is, the obtaining at block 308 may include registering an association between the person 110 and the user device 114 of the person 110. Alternatively or additionally, the obtaining at block 308 may include registering an association between the person 110 and the access control application 116 executed by the user device 114. The association may indicate a correspondence between the user device 114 and the person 110. In some aspects, the obtaining at block 308 may include accepting identification information of the person 110 from the user device 114 based at least on the registered association between the person 110 and the user device 114. Alternatively or additionally, the obtaining at block 308 may include rejecting identification information of the person 110 from another user device 114 that is not registered to the person 110.

In other optional or additional aspects, the obtaining at block 308 may include obtaining identification information from the user device 114 of the person 110. The identification information may be individually associated with the user device 114 and/or with the access control application 116. For example, the identification information may comprise an identifier generated by the person 110 (e.g., password), an identifier generated by the access control system 100 (e.g., a single-use code, a QR code), and/or an identifier of the user device 114 (e.g., a MAC address). In some aspects, the obtaining at block 308 may include obtaining the identification information by receiving the identification information that has been transmitted by the user device 114. In other optional or additional aspects, the obtaining at block 308 may include obtaining the identification information that is displayed by the user device 114 using the camera of the sensor 104 and/or the camera of the input device 106. For example, the user device 114 and/or the access control application 116 may display an image-based code (e.g., a QR code) and the obtaining at block 308 may include obtaining receive visual data comprising the image-based code from the camera of the sensor 104 and/or the camera of the input device 106.

In other optional or additional aspects, the obtaining at block 308 may include detecting that the user device 114 of the person 110 is within a threshold distance of the access control area 101. In other optional or additional aspects, the obtaining at block 308 may include receiving, from the user device 114, the identification information of the person, the identification information comprising at least one of an access code, a QR code, and electronic identification information of the person.

Further, for example, the obtaining at block 308 may be performed to obtain identification information of the person 110 with which the person 110 may be identified. The identification information may allow the access control system 100 to determine whether the person 110 is to be granted/denied access to an specific location in a building and/or facility, such as access control area 101.

At block 310, the method 300 includes identifying the person according to the identification information of the person. For example, in an aspect, the computing device 120, the processor 123, the memory 125, the frictionless access control component 127, and/or the identifying component 240 may be configured to or may comprise means for identifying the person 110 according to the identification information of the person 110.

For example, the identifying at block 310 may include performing voice recognition analysis on the voice and/or audio data of the person 110. That is, the identifying at block 310 may include performing voice recognition analysis on a set of words or phrases spoken by the person 110 to identify the voice of the speaker as corresponding to the person 110. For example, the identifying at block 310 may include comparing the voice and/or audio data with previously recorded voice and/or audio data that is known to have been spoken by the person 110. Alternatively or additionally, the identifying at block 310 may include performing speech recognition analysis on a predetermined set of words or phrases (e.g., verbal passcode) spoken by the person 110 to recognize the predetermined set of words or phrases. That is, the identifying at block 310 may include identifying the person 110 based on a determination that the set of words or phrases spoken by the person 110 match a predetermined verbal passcode corresponding to the person 110.

In other optional or additional aspects, the identifying at block 310 may include identifying the person 110 based at least on gesture data of the person 110. In such aspects, the identifying at block 310 may include interpreting the body movements of the person 110 while performing a gesture. The identifying at block 310 may include identifying the person 110 based at least on a determination that the gesture performed by the person 110 matches a predetermined gesture corresponding to the person 110.

In other optional or additional aspects, the identifying at block 310 may include identifying the person 110 based at least on identification information obtained from a scan of an identification device presented by the person 110 (e.g., badge, key fob, NFC card, RFID tag, or the like). That is, the identifying at block 310 may include identifying the person 110 based at least on a determination that the identification information obtained from the scan corresponds to the person 110.

In other optional or additional aspects, the identifying at block 310 may include identifying the person 110 based at least on iris scan data of the person 110. That is, the identifying at block 310 may include identifying the person 110 based at least on a determination that the iris scan data corresponds to the person 110.

In other optional or additional aspects, the identifying at block 310 may include identifying the person 110 based at least on heartbeat scan data of the person 110. That is, the identifying at block 310 may include identifying the person 110 based at least on a determination that the heartbeat scan data corresponds to the person 110.

In other optional or additional aspects, the identifying at block 310 may include identifying the person 110 based at least on gait scan data of the person 110. That is, the identifying at block 310 may include identifying the person 110 based at least on a determination that the gait scan data corresponds to the person 110.

In other optional or additional aspects, the identifying at block 310 may include identifying the person 110 based at least on identification information of the person 110 received from the user device 114. That is, the identifying at block 310 may include identifying the person 110 based at least on a determination that the identification information of the person 110 received from the user device 114 corresponds to the person 110. For example, the identifying at block 310 may include identifying the person 110 based at least on a determination that a QR code displayed by the user device 114 corresponds to the person 110.

In other optional or additional aspects, the identifying at block 310 may include determining whether the person 110 should be granted entry/exit based at least on a determination that the identification information identifies the person 110 and that the person 110 is permitted to be granted entry/exit. In some aspects, the identifying at block 310 may include granting access to the person 110 if or when the identifying at block 310 has determined that the person 110 should be granted entry. For example, if or when the identifying at block 310 has determined that the person 110 should be granted entry, the identifying at block 310 may include unlocking the locking mechanism of the checkpoint 102, showing on the display of the input device 106 a green light and/or an image of an open lock, and/or generating, with the speaker of the input device 106, one or more sounds (e.g., a bell sound) indicating that the person 110 has been granted access.

In other optional or additional aspects, the identifying at block 310 may include causing the access control system 100 to deny access to the person 110 if or when the identifying at block 310 may include identifying has determined that the person 110 should not be granted entry/exit. For example, if or when the identifying at block 310 has determined that the person 110 should be denied entry/exit, the identifying at block 310 may include locking the locking mechanism of the checkpoint 102, showing on the display of the input device 106 a red light and/or an image of a closed lock, and/or generating, with the speaker of the input device 106, one or more sounds (e.g., a buzzer sound) indicating that the person 110 has been denied access.

Further, for example, the identifying at block 310 may be performed to identify the person 110 and determine whether the person 110 is to be granted/denied access to an specific location in a building and/or facility, such as access control area 101. Thus, aspects presented herein may reduce time and labor needed for prevent the spread of a contagious disease. Further, aspects presented herein may increase effectiveness of sanitation protocols over conventional access control systems.

Referring to FIG. 4, in an optional or additional aspect that may be combined with any other aspect, at block 402, the determining at block 304 of determining whether the person 110 is wearing the mask 112 may include capturing visual data of the access control area. For example, in an aspect, the computing device 120, the processor 123, the memory 125, the frictionless access control component 127, and/or the capturing component 245 may be configured to or may comprise means for capturing visual data of the access control area 101.

For example, the capturing at block 402 may include capturing the visual data from the sensor 104 and/or from the input device 106. Alternatively or additionally, the capturing at block 402 may include capturing other visual data from the camera of user device 114. The visual data may comprise images, video frames, and/or video feeds of the access control area 101. The image quality of the visual data (e.g., resolution, frame rate) may be sufficient to determine whether the person 110 is located at the access control area 101 and/or whether the person 110 located at the access control area 101 is wearing a mask 112.

Further, for example, the capturing at block 402 may be performed to capture visual data of the person 110 located at the access control area 101. The access control system 100 may analyze the visual data to determine whether the person 110 is wearing a mask 112. Such a determination may allow the access control system 100 to be automatically switched into the frictionless mode. Thus, aspects presented herein may reduce time and labor needed for prevent the spread of a contagious disease. Further, aspects presented herein may increase effectiveness of sanitation protocols over conventional access control systems.

In this optional or additional aspect, at block 404, the determining at block 304 of determining whether the person 110 is wearing the mask 112 may include extracting visual characteristics of the person from the visual data. For example, in an aspect, the computing device 120, the processor 123, the memory 125, the frictionless access control component 127, and/or the extracting component 250 may be configured to or may comprise means for extracting visual characteristics of the person 110 from the visual data.

For example, the extracting at block 404 may include extracting the visual characteristics of the person 110 using a visual characteristics detection algorithm. The visual characteristics detection algorithm may be configured to detect visual characteristics of the person 110 from the visual data. For example, the visual characteristics detection algorithm may comprise a machine learning classifier having been trained to extract visual characteristics (e.g., eyes, noses, mouths, ears) from visual data in which the person 110 appears. Alternatively or additionally, the visual characteristics detection algorithm may compare properties of base images of visual characteristics with the properties of the visual data, such as color (e.g., hue, lightness, or saturation), object shape (e.g., shape of face), object size (e.g., of person), and/or other conventional image comparison attributes.

Further, for example, the extracting at block 404 may be performed to determine whether certain visual characteristics of the person 110 indicate whether the person 110 is wearing mask. Such a determination may allow the access control system 100 to be automatically switched into the frictionless mode. Thus, aspects presented herein may reduce time and labor needed for prevent the spread of a contagious disease. Further, aspects presented herein may increase effectiveness of sanitation protocols over conventional access control system.

In this optional or additional aspect, at block 406, the determining at block 304 of determining whether the person 110 is wearing the mask 112 may include determining whether the person is wearing the mask based at least on the visual characteristics of the person. For example, in an aspect, the computing device 120, the processor 123, the memory 125, the frictionless access control component 127, and/or the determining component 225 may be configured to or may comprise means for determining whether the person 110 is wearing the mask 112 based at least on the visual characteristics of the person.

For example, the determining at block 406 may include determining whether the visual characteristics of the person 110 indicate that a portion of a face of the person 110 is covered. The portion of the face of the person 110 may comprise at least one of a nose and a mouth of the person 110.

In other optional or additional aspects, the determining at block 406 may include determining that the person 110 is wearing the mask 112 based at least on determining that the portion of the face of the person 110 is covered. For example, if or when the visual characteristics of the person 110 do not comprise visual characteristics of a nose and a mouth, the determining at block 406 may include determining that the portion of the face of the person 110 is covered and that the person 110 is wearing the mask 112. That is, if or when both the nose and the mouth of the person 110 are covered (e.g., hidden from view), the person 110 is likely to be wearing the mask 112.

For another example, if or when the visual characteristics of the person 110 comprise visual characteristics of a nose and/or a mouth, the determining at block 406 may include determining that the portion of the face of the person 110 is uncovered and that the person 110 is not wearing the mask 112. That is, if or when the nose and/or the mouth of the person 110 are uncovered (e.g., visible), the person 110 is unlikely to be wearing the mask 112.

Further, for example, the determining at block 406 may be performed to determine whether or not the person 110 is wearing mask. Such a determination may allow the access control system 100 to be automatically switched into the frictionless mode. Thus, aspects presented herein may reduce time and labor needed for prevent the spread of a contagious disease. Further, aspects presented herein may increase effectiveness of sanitation protocols over conventional access control systems.

It is understood that the specific order or hierarchy of blocks in the processes/flowcharts disclosed is an illustration of example approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

In one or more aspects, the functions described herein may be implemented in hardware, software, firmware, or any combination thereof. If or when implemented in software, the functions may be stored or transmitted as one or more instructions or code on a computer-readable medium. The computer-readable medium (also referred to as computer-readable media) may include a computer storage medium which may be referred to as a non-transitory computer-readable medium. A non-transitory computer-readable medium may exclude transitory signals. Computer-readable media may include both computer storage media and communication media including any medium that may facilitate transfer of a computer program from one place to another. A storage medium may be any available media that can be accessed by a computer. By way of example, and not limitation, such computer-readable media can comprise RAM, ROM, electrically erasable programmable ROM ("EEPROM"), compact disc read-only memory ("CD-ROM") or other optical disk storage, magnetic disk storage or other magnetic storage devices, or any other medium that can be used to store desired program code in the form of instructions or data structures and that can be accessed by a computer. Disk and disc, as used herein, may include compact disc ("CD"), laser disc, optical disc, digital versatile disc ("DVD"), floppy disk and Blu-ray disc, where disks usually reproduce data magnetically, while discs usually reproduce data optically with lasers. Combinations of the above may also be included within the scope of computer-readable media.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims.

Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A method of operating an access control system, comprising:

detecting a person at an access control area;

determining whether the person is wearing a mask;

switching, in response to determining that the person is wearing the mask, the access control system into a frictionless mode;

obtaining, according to the frictionless mode, identification information of the person via touchless interaction between the person and the access control system; and identifying the person according to the identification information of the person.

2. The method of claim 1, wherein determining whether the person is wearing the mask comprises:

capturing visual data of the access control area;

extracting visual characteristics of the person from the visual data; and determining whether the person is wearing the mask based at least on the visual characteristics of the person.

3. The method of claim 2, wherein determining whether the person is wearing the mask based at least on the visual characteristics of the person comprises:

determining whether the visual characteristics of the person indicate that a portion of a face of the person is covered, the portion of the face of the person comprising at least one of a nose and a mouth; and determining that the person is wearing the mask based at least on determining that the portion of the face of the person is covered.

4. The method of claim 1, wherein obtaining the identification information of the person via the touchless interaction comprises:

obtaining biometric data of the person, the biometric data comprising at least one of voice data, iris scan data, heartbeat scan data, and gait scan data.

5. The method of claim 1, wherein obtaining the identification information of the person via the touchless interaction comprises:

detecting a user device of the person within a threshold distance of the access control area; and receiving, from the user device, the identification information of the person, the identification information comprising at least one of an access code, a Quick Response ("QR") code, and electronic identification information of the person.

6. The method of claim 5, further comprising:

registering an association between the person and the user device of the person.

7. The method of claim 1, wherein switching the access control system into the frictionless mode comprises:

switching the access control system into the frictionless mode based on determining that a time period requirement is met, the time period requirement indicating one or more time periods during which the access control system is permitted to be configured in the frictionless mode.

8. An apparatus of an access control system, comprising:

a non-transitory memory storing computer-executable instructions; and a processor communicatively coupled with the non-transitory memory and configured to execute the computer-executable instructions to:

detect a person at an access control area;

determine whether the person is wearing a mask;

switch, in response to a determination that the person is wearing the mask, the access control system into a frictionless mode;

obtain, according to the frictionless mode, identification information of the person via touchless interaction between the person and the access control system; and identify the person according to the identification information of the person.

9. The apparatus of claim 8, wherein to determine whether the person is wearing the mask comprises computer-executable instructions to:

capture visual data of the access control area;

extract visual characteristics of the person from the visual data; and determine whether the person is wearing the mask based at least on the visual characteristics of the person.

10. The apparatus of claim 9, wherein to determine whether the person is wearing the mask based at least on the visual characteristics of the person comprises computer-executable instructions to:

determine whether the visual characteristics of the person indicate that a portion of a face of the person is covered, the portion of the face of the person comprising at least one of a nose and a mouth; and determine that the person is wearing the mask based at least a determination that the portion of the face of the person is covered.

11. The apparatus of claim 8, wherein to obtain the identification information of the person via the touchless interaction comprises computer-executable instructions to:

obtain biometric data of the person, the biometric data comprising at least one of voice data, iris scan data, heartbeat scan data, and gait scan data.

12. The apparatus of claim 8, wherein to obtain the identification information of the person via the touchless interaction comprises computer-executable instructions to:

detect a user device of the person within a threshold distance of the access control area; and receive, from the user device, the identification information of the person, the identification information comprising at least one of an access code, a Quick Response ("QR") code, and electronic identification information of the person.

13. The apparatus of claim 12, wherein the processor is configured to execute further computer-executable instructions to:

register an association between the person and the user device of the person.

14. The apparatus of claim 8, wherein to switch the access control system into the frictionless mode comprises computer-executable instructions to:

switch the access control system into the frictionless mode based on a determination that a time period requirement is met, the time period requirement indicating one or more time periods during which the access control system is permitted to be configured in the frictionless mode.

15. A non-transitory computer-readable medium storing computer-readable instructions for operating an access control system, executable by a processor to:

detect a person at an access control area;

determine whether the person is wearing a mask;

switch, in response to a determination that the person is wearing the mask, the access control system into a frictionless mode;

obtain, according to the frictionless mode, identification information of the person via touchless interaction between the person and the access control system; and identify the person according to the identification information of the person.

16. The non-transitory computer-readable medium of claim 15, wherein to determine whether the person is wearing the mask comprises computer-executable instructions to:

capture visual data of the access control area;

extract visual characteristics of the person from the visual data; and determine whether the person is wearing the mask based at least on the visual characteristics of the person.

17. The non-transitory computer-readable medium of claim 16, wherein to determine whether the person is wearing the mask based at least on the visual characteristics of the person comprises computer-executable instructions to:

determine whether the visual characteristics of the person indicate that a portion of a face of the person is covered, the portion of the face of the person comprising at least one of a nose and a mouth; and determine that the person is wearing the mask based at least on a determination that the portion of the face of the person is covered.

18. The non-transitory computer-readable medium of claim 15, wherein to obtain the identification information of the person via the touchless interaction comprises computer-executable instructions to:

obtain biometric data of the person, the biometric data comprising at least one of voice data, iris scan data, heartbeat scan data, and gait scan data.

19. The non-transitory computer-readable medium of claim 15, wherein to obtain the identification information of the person via the touchless interaction comprises computer-executable instructions to:

register an association between the person and an user device of the person;

detect the user device of the person within a threshold distance of the access control area; and receive, from the user device, the identification information of the person, the identification information comprising at least one of an access code, a Quick Response ("QR") code, and electronic identification information of the person.

20. The non-transitory computer-readable medium of claim 15, wherein to switch the access control system into the frictionless mode comprises computer-executable instructions to:

switch the access control system into the frictionless mode based on a determination that a time period requirement is met, the time period requirement indicating one or more time periods during which the access control system is permitted to be configured in the frictionless mode.

* * * * *